United States Patent [19]

Le Magourou

[11] Patent Number: 4,678,254

[45] Date of Patent: Jul. 7, 1987

[54] HIGH INTENSITY POWER PLUG

[75] Inventor: Yves Le Magourou, Ermont, France

[73] Assignee: Societe D'Exploitation des Procedes Marechal (SEPM), Paris, France

[21] Appl. No.: 811,475

[22] Filed: Dec. 20, 1985

[30] Foreign Application Priority Data

Dec. 27, 1984 [EP] European Pat. Off. ..... 84 402722.7

[51] Int. Cl.[4] ..... H01R 13/44

[52] U.S. Cl. ..... 439/139; 439/137

[58] Field of Search ..... 339/40–43, 339/75 M, 89 R, 89 M; 200/51.3, 51.7–51.9

[56] References Cited

U.S. PATENT DOCUMENTS

| | | | |
|---|---|---|---|
| 4,148,536 | 4/1979 | Petropoulsos et al. | 339/42 |
| 4,271,337 | 6/1981 | Barkas | 200/51.09 |
| 4,472,611 | 9/1984 | Schoch | 200/51.03 |
| 4,520,243 | 5/1985 | McIntyre | 339/41 |
| 4,525,610 | 6/1985 | LeMagourou | 339/41 |
| 4,528,429 | 7/1985 | Dobson et al. | 339/40 |

FOREIGN PATENT DOCUMENTS

| | | | |
|---|---|---|---|
| 694056 | 7/1940 | Fed. Rep. of Germany | 339/40 |
| 2643668 | 3/1978 | Fed. Rep. of Germany | 339/41 |
| 2161539 | 7/1973 | France . | |
| 2253292 | 6/1975 | France . | |

*Primary Examiner*—Eugene F. Desmond
*Assistant Examiner*—Paula A. Austin
*Attorney, Agent, or Firm*—Sandler & Greenblum

[57] ABSTRACT

A switch including a plug and a socket for use with high intensity currents includes a power circuit and a pilot circuit for maintaining current flowing through the power circuit. The switch also includes an apparatus for controlling the pilot circuit and preventing insertion of the plug into the socket when the at least one socket pilot contact and the at least one plug pilot contacts are in a closed position.

46 Claims, 12 Drawing Figures

HIGH INTENSITY POWER PLUG

BACKGROUND OF THE INVENTION

1. Field of the Invention

The invention relates to an electric power connection, and more particularly, to those connections adapted for use with high intensity currents.

2. Description of Relevant Materials and Background Art

The invention relates to an electric power connection, and more particularly, to a connection used with high intensity currents.

Electric current power connections are formed, in a known manner, by socket and a plug each provided with power contacts adapted to be electrically connected or disconnected from one another.

In high intensity power plugs, there is generally provided a parallel low intensity circuit, hereinafter referenced as a pilot circuit. This pilot circuit is provided with pilot contacts provided in the socket and the plug. As the pilot circuit is closed it controls an energizing apparatus whereby the power contacts are energized, and conversely, as the pilot circuit is opened, it controls a de-energizing apparatus to de-energize the power contacts.

Accordingly, the pilot circuit is closed only after the power contacts have made contact, and opened before the power contacts are disconnected. In this manner, the two operations of closing and opening the pilot circuit occur when the electrical power plug is not energized.

It is in effect often imperative to bring the power contacts together or to separate them when they are not turned on particulrly so as to avoid electric arcing and so as not to establish power other than when the power contacts are electrically connected.

Generally speaking, the power contacts of the plug and of the socket are connected and disconnected by plugging in and unplugging, respectively, the plug and the socket.

SUMMARY OF THE INVENTION

According to an embodiment of the invention, an electric power connection includes a socket and a plug. The socket includes first power contacts and the plug includes second power contacts adapted to be connected to the first power contacts. The switch also includes a pilot circuit comprising first pilot contacts provided in the socket and second pilot contacts provided in the plug. The pilot circuit controls the de-energization and energization of the first power contacts when the circuit is opened and closed, respectively. The switch also includes manipulation means for preventing certain movements of the plug and the socket when the pilot circuit is in a closed position and for allowing the certain movements when the pilot circuit is in an open position.

The manipulation means is provided either on the socket to act on the first pilot contacts or on the plug to act on the second pilot contacts. The manipulation means prevents the first power contacts from engaging and disengaging from the second power contacts when the pilot circuit is in its closed position. The pilot circuit is opened and closed by disengaging and engaging, respectively, the first pilot contacts and the second pilot contacts. The first power contacts and the second power contacts are engaged and disengaged from one another by plugging and unplugging, respectively, the plug and the socket.

The switch further includes means for preventing activation of the manipulation means while the plug is not inserted into the socket sufficiently to cause the first power contacts to engage the second power contacts, wherein when the manipulation means is activated, the pilot circuit is moved towards a closed position. The means for preventing activation of the manipulation means is provided on the plug, on the socket or on the socket and on the plug.

The first and second pilot contacts each include a contact head. The contact heads of the first pilot contacts are movable and the contact heads of the second pilot contacts are fixed. The manipulation means acts on the movable contact heads to move them towards and away from the fixed contact heads for connecting and disconnecting, respectively, the first pilot contacts and the second pilot contacts. The first and second pilot contacts are end contacts and the movable contact heads are adapted to be moved by springs and flexible conductors. The springs and flexible conductors are positioned within a block and the block is axially movably mounted and adapted to be moved by the manipulation means. The manipulation means includes a rotating means comprising a driving spur which cooperates with an opening in the block for translationally moving the block when the driving spur moves along an arcuate path.

According to an embodiment of the invention, the contact heads of the second pilot contacts are movable and the contact heads of the first pilot contacts are fixed. The manipulation means acts on the movable contact heads to move them towards and away from the fixed contact heads for connecting and disconnecting, respectively, the first pilot contacts and the second pilot contacts. The first and second pilot contacts are end contacts and the movable contact heads are adapted to be moved by springs and flexible conductors. The springs and flexible conductors are positioned within a block and the block is axially movably mounted and adapted to be moved by the manipulation means. The manipulation means comprises rotating means comprising a driving spur which cooperates with an opening in the block for translationally moving the block when the driving spur moves along an arcute path.

The plug is introduced into the socket and connection of the power contacts is achieved by turning the plug in the socket.

The manipulation means includes a rotating activation portion comprising a cam and at least one first abutment having a configuration which cooperates with the cam such that when the plug is introduced into the socket and the pilot circuit is in a closed position, the cam abuts against a first portion of the at least one first abutment and prevents further introduction of the plug into the socket. When the plug is introduced into the socket and the pilot circuit is in an open position, the cam and the abutment do not prevent further introduction of the plug into the socket. The pilot circuit is closed by rotation of the cam after rotation of the plug within the socket and connection of the power contacts. After rotation of the cam, inverse rotation of the plug is blocked by cooperation of the cam and a second portion of the at least one first abutment and by hooking means provided on the plug and the socket.

The cam is provided on an exterior portion of either the socket or the plug, and the at least one first abutment is provided either on the plug or on the socket, respectively.

The hooking means includes pins provided in the plug and projections provided in the socket. The pins are adapted to hook under the projections in response to rotation of the plug in the socket. The projections include an inclined surface having an orientation which allows the plug to be brought closer to the socket during rotation of the plug in the socket and allows a sealing joint positioned between the plug and the socket to be crushed.

The socket includes at least one second abutment adapted to prevent rotation of the plug in an incorrect direction after the plug is introduced into the socket, and at least one third abutment adapted to limit rotation of the plug in the socket. The at least one second and third abutments are adapted to cooperate with the pins. The socket further includes an edge. The edge includes openings adapted to receive the pins. The openings have an angular orientation such that proper introduction of the plug into the socket is imposed.

The manipulation means further includes blockage means for the open position and the closed position of the pilot circuit.

According to an embodiment of the invention, an electric power connection includes a socket comprising at least one socket power contact and a plug comprising at least one plug power contact. The at least one plug power contact corresponds in number and placement to the at least one socket power contact. The connection also includes a pilot circuit comprising at least one socket pilot contact and at least one plug pilot contact. The at least one plug pilot contact corresponds in number and placement to the at least one socket pilot contact. The pilot circuit is adapted to control the power supplied to the at least one plug power contact and the at least one socket power contact. The connection also includes manipulation means for controlling the pilot circuit and preventing insertion of the plug into the socket when the at least one socket pilot contact and the at least one plug pilot contacts are in a closed position.

Each of the at least one socket pilot contacts comprise a contact head located on a free end of the at least one socket pilot contact. Each of the at least one plug pilot contacts comprise a contact head located on a free end of the at least one plug pilot contact. The contact heads of the at least one socket contact are movable and the contact heads of the at least one plug contact are fixed. The manipulation means acts on the contact heads of the at least one socket contact to move them both towards and away from the contact heads of the at least one plug contact, whereby the at least one socket pilot contact is operatively connected to the at least one plug pilot contact when the at least one socket pilot contact comes into contact with the at least one plug pilot contact.

The connection also includes an axially movable block mounted in the socket. The block includes a plurality of springs and flexible conductors for moving the contact heads of the at least one socket contact. The manipulation means is operable to move the block from a first position to a second position and from the second position to the first position. The manipulation means includes a driving spur rotatably mounted in the manipulation means for cooperating with a groove in the block for translationally moving the block from a first position to a second position and from the second position to the first position, when the driving spur moves along an arcuate path.

The manipulation means further includes a cam connected to an exterior portion of the socket connected to the driving spur and at least one first abutment adapted to cooperate with the cam such that rotation of the cam is prevented until the plug is fully inserted into the socket and complete insertion of the plug into the socket is prevented when the block is in the second position.

The pilot circuit is closed by rotation of the cam after the plug is fully inserted into the socket and the plug is rotated within the socket. The rotation of the cam causes the driving spur to move along the arcuate path and thereby move the block to the second position causing the contact heads of the at least one socket contact to come into contact with the contact heads of the at least one plug contact. After rotation of the cam, inverse rotation of the plug within the socket is prevented by cooperation of the cam and a portion of the at least one first abutment and by hooking means provided on the plug and the socket.

The hooking means includes a plurality of pins located on the plug, and a plurality of corresponding projections located on the socket. The plurality of pins are adapted to hook under the plurality of projections in response to rotation of the plug in the socket. The plurality of projections each includes an inclined surface having an orientation such that the plug is brought closer to the socket during rotation of the plug in the socket and a sealing joint positioned between the plug and the socket is crushed.

The socket includes at least one second abutment adapted to prevent rotation of the plug in an incorrect direction after the plug is introduced into the socket, and at least one third abutment adapted to limit rotation of the plug in the socket. The at least one second and third abutments are adapted to cooperate with the pins. kThe socket also includes an edge. The edge includes openings adapted to receive the pins. The openings have an angular orientation such that proper introduction of the plug into the socket is assured.

The manipulation means further includes blockage means for locking the pilot circuit in the open position and the closed position.

According to an embodiment of the invention, a switch includes a plug and a socket for use with high intensity currents. The switch includes a power circuit, a pilot circuit for maintaining current flowing through the power circuit, and means for controlling the pilot circuit and preventing insertion of the plug into the socket when the at least one socket pilot contact and the at least one plug pilot contacts are in a closed position.

The power circuit includes at least one socket power contact poisitioned in the socket, and at least one plug power contact positioned in the plug. Current flows through the power circuit when the at least one socket power contact comes into contact with the at least one plug power contact and the pilot circuit is closed.

The pilot circuit includes at least one socket pilot contact positioned in the socket and at least one plug pilot contact positioned in the plug. Current flows through the power circuit only when the at least one socket pilot contact comes into contact with the at least one plug pilot contact. The means for controlling the pilot circuit includes a block in which the at least one socket pilot contact is located. The block is axially movable between a first and second position. When the block is in the second position, the at least one socket pilot contact is in contact with the at least one plug pilot contact.

The means for controlling the pilot circuit further includes a driving spur rotatably mounted in the means for controlling the pilot circuit for cooperating with a groove in the block for axially moving the block between the first and second positions as the driving spur moves along an arcuate path. The means for controlling also includes a cam connected to the driving spur and at least one abutment adapted to cooperate with the cam to prevent rotation of the cam unless the plug is fully inserted in the socket and to prevent complete insertion of the plug into the socket unless the block is in the first position. The pilot circuit is closed by rotation of the cam after the plug is fully inserted into the socket and the plug is rotated within the socket. The driving spur moves along the arcuate path in response to rotation of the cam, the block axially moves from the first position to the second position in response to the driving spur, and the at least one socket pilot contact engages the at least one plug pilot contact in response to the block movement.

BRIEF DESCRIPTION OF DRAWINGS

The invention will now be described with reference to the drawings, given by way of non-limiting example, in which.

DESCRIPTION OF PREFERRED EMBODIMENTS

Figure 1:
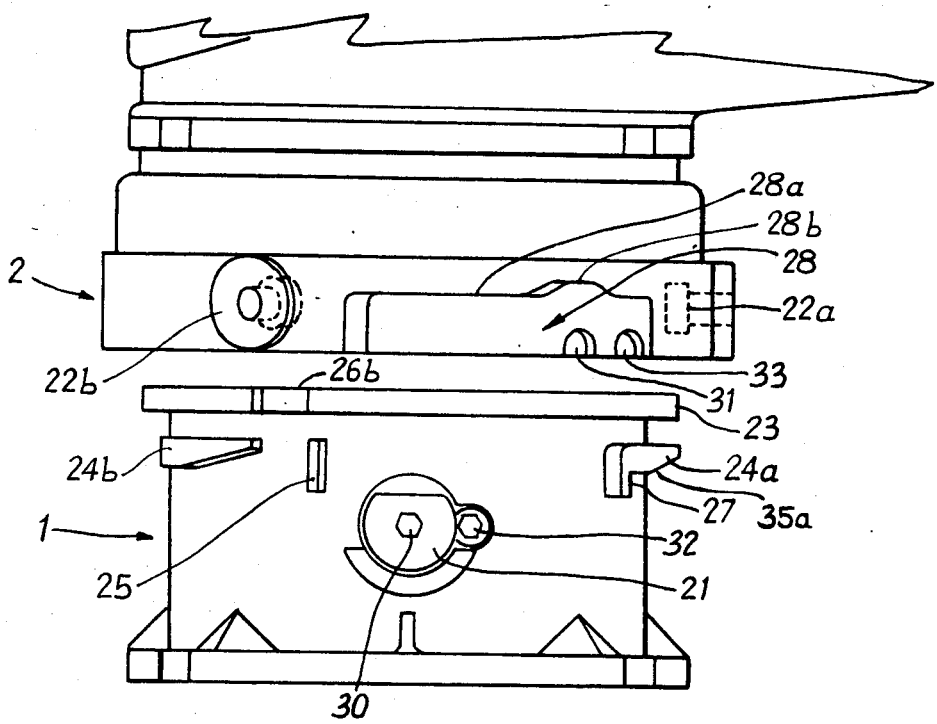
FIG. 1 is an elevational view of the socket and of a portion of the plug according to one embodiment of the invention.
Figure 2:
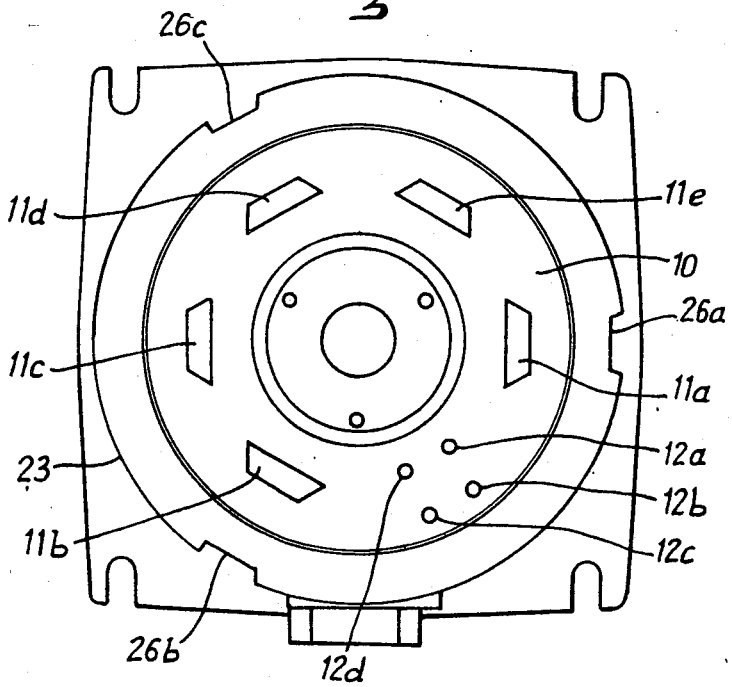
FIG. 2 is a top view of the socket.

The invention relates to a connection of the type provided with a pilot circuit. The connection is notable in that the pilot contacts of the socket and of the plug are connected or disconnected from one another so as to close or open the pilot circuit by means of a manipulation apparatus which acts on the pilot contacts of the socket or of the plug. The manipulation apparatus is provided on the socket or on the plug, respectively, in a manner such that the apparatus prevents at least certain manipulations of plugging in or separating the plug and the socket when the contacts of pilot circuit are in the closed position. Thus when the pilot contacts of the pilot circuit are in the closed position, the manipulation apparatus prevents the power contacts from being connected or disconnected. Thus, when the plug is not inserted in the socket, but the block is in an upper position whereby if the plug was there the pilot circuit would be closed, the insertion of the plug is prevented. The apparatus, to the contrary, allows the manipulations when the pilot circuit is in the open position.

Such an apparatus offers a large measure of safety because it prevents the power contacts of the plug and of the socket from being, on the one hand, connected and, on the other hand, disconnected, when these power contacts of the plug and socket are energized.

Preferably, and this further improves safety, the plug and/or respectively the socket is provided with means which prevents the manipulation apparatus from being activated to drive the pilot circuit towards its closed position while the insertion of the plug is not sufficient to cause the connection of the power contacts.

According to a preferred embodiment, the contact heads of the pilot contacts of either the socket or of the plug are movable and those of the plug or of the socket, respectively, are fixed. The manipulation apparatus acts on the mobile contact heads to bring them towards and away from the fixed contact heads so as to cause the pilot contacts to be connected and disconnected.

Preferably, in this case, the pilot contacts are end contacts. The mobile contact heads of the socket or of the plug are positioned, with the assistance of springs and flexible conductors or braided cables, in a block which is axially movably mounted and which is moved by the manipulation apparatus.

Preferably, the manipulation apparatus is a rotating apparatus provided with a motor or driving spur which cooperates with an opening in the block in which the contact heads are located. The block is translationally moved as the spur is moved along an arcuate path.

The invention relates more particularly, but not exclusively, to a power connection whose activation consists of first introducing the plug into the socket and then turning the plug in the socket, to obtain connection of the power contacts.

One embodiment according to the invention, is notable in that the manipulation apparatus of the pilot contacts has a rotatable activation portion in the form of a cam provided on the exterior of the socket or of the plug on which the cam is mounted. The plug or the socket, whichever does not include the cam, has at least one abutment whose configuration cooperates with the configuration of the cam. In the relative introduction position of the plug into the socket, that is, as the plug is being introduced into the socket, the cam, when the pilot circuit is in the closed position, makes contact with at least one portion of the abutment and prevents the introduction. The cam does not affect the introduction of the plug into the socket when the pilot circuit is in the open position. The manipulation for closing the pilot circuit by rotation of the cam is possible after the rotation of the plug and thus after the power contacts have been connected. In this position, the cam blocks rotation of the plug in the opposite direction by cooperating with a corresponding portion of the abutment and by virtue of hooking means provided on the plug and the socket.

The hooking means is, for example, formed by pins provided in the plug and projections provided on the socket. The pins are adapted to be moved into position under the projections by rotation of the plug in the socket.

Preferably, the projections of the socket thus have an inclined section whose orientation allows the plug to be brought together into the socket in the course of the rotation of the plug in the socket. This orientation also allows a sealing joint positioned between the plug and the socket to be crushed.

Furthermore, and preferably, the socket has at least one abutment adapted to prevent rotation of the plug in the wrong direction after its introduction into the socket. The socket also includes at least one abutment adapted to limit the abutment which cooperate with the pins of the plug at the end of the rotational course of the plug in the socket.

Thus, the socket preferably is provided with an edge which is provided with reserves or openings adapted for passage of the pins of the plug. The angular position of the openings is such that the openings provide for the proper introduction and positioning of the plug in the socket.

Likewise, to further compliment the safety provided by the apparatus, the manipulation apparatus of the pilot contacts is provided with blockage means in the closed and/or the opened position of the pilot circuit. The blockage means serve to lock the pilot circuit in the open or closed position.

Other details and advantages are likewise provided in the invention.

Figure 5:
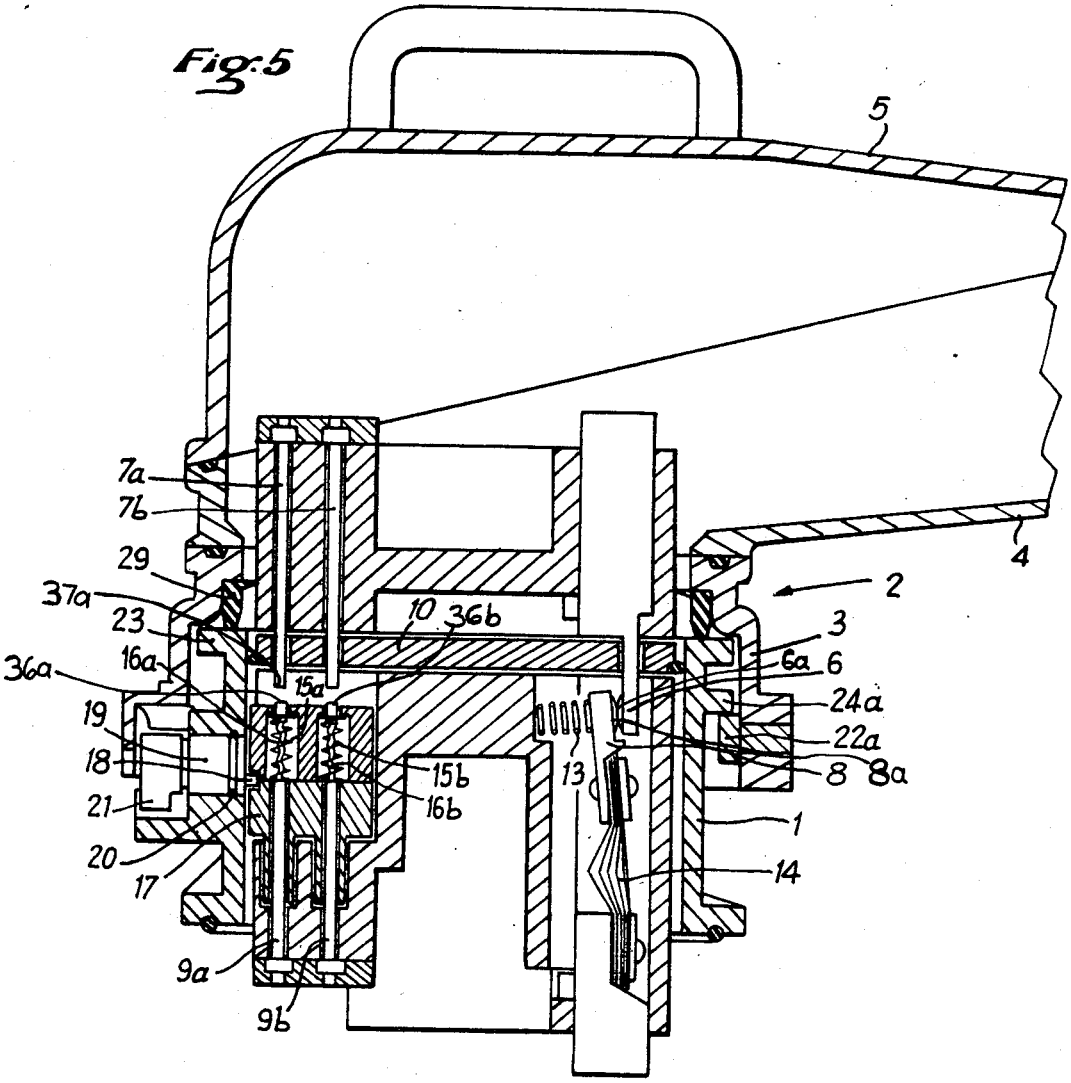
FIG. 5 is an axial cross-sectional view of the plug and the socket with the power contacts connected and the pilot circuit open.
Figure 6:
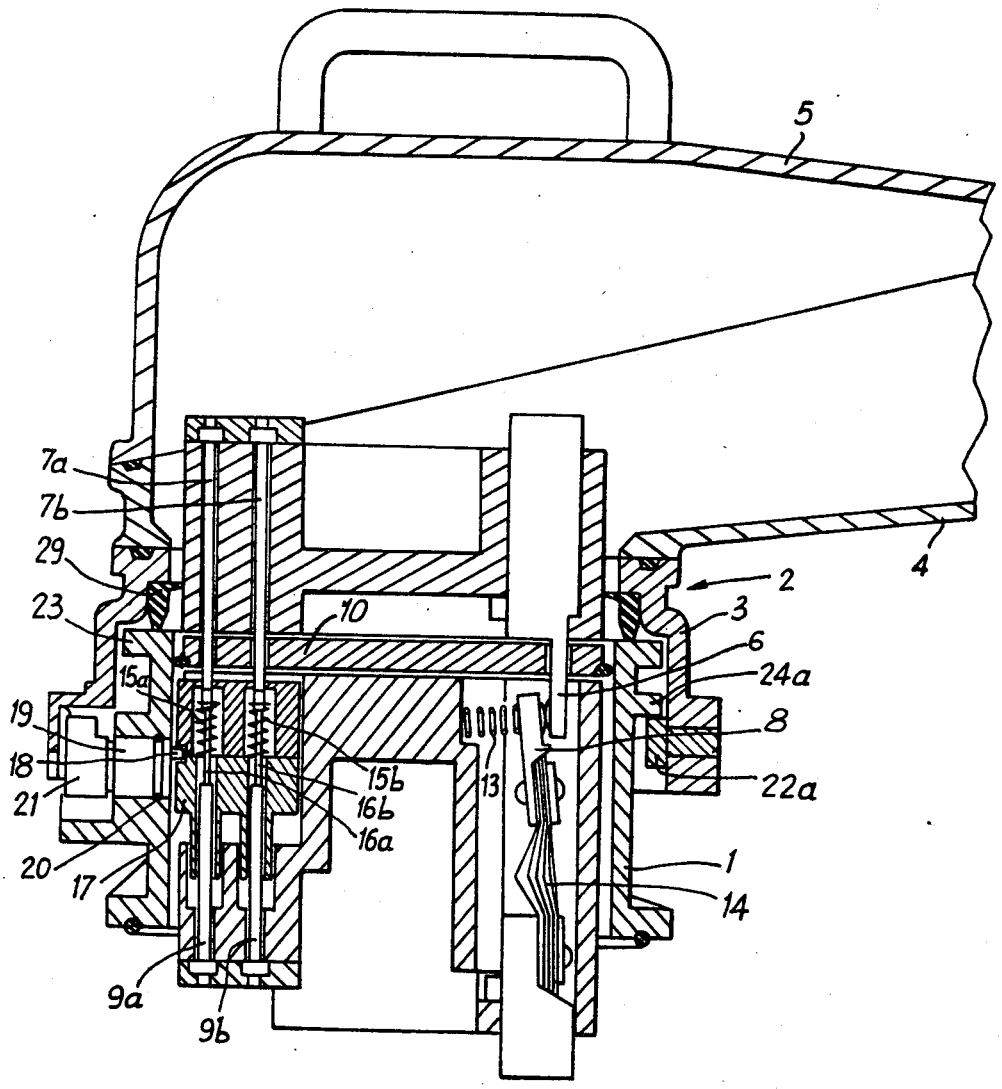
FIG. 6 is an axial cross-sectional view of the plug and the socket with the power contacts open; and FIGS. *7a, 7b, 7c* and *7d* schematically show a plurality of relative positions of a portion of the body of the plug with respect to the apparatus for manipulating the pilot contacts along with the corresponding positions of a pilot contact, facing each other.

FIGS. 1, 5 and 6 illustrate a connection comprising socket 1 and plug 2. The plug is formed of plug body 3, grip body 4 and grip casing 5 (clearly shown in FIGS. 5 and 6).

Plug grip body 4, and grip casing 5 are angled to facilitate the manipulations which will be discussed below.

The plug comprises power contacts 6 and pilot contacts 7*a*, 7*b*, which are in the form of pins (shown in FIGS. 5 and 6).

The socket is likewise provided with power contacts 8 and pilot contacts 9*a*, 9*b*.

Figure 9:
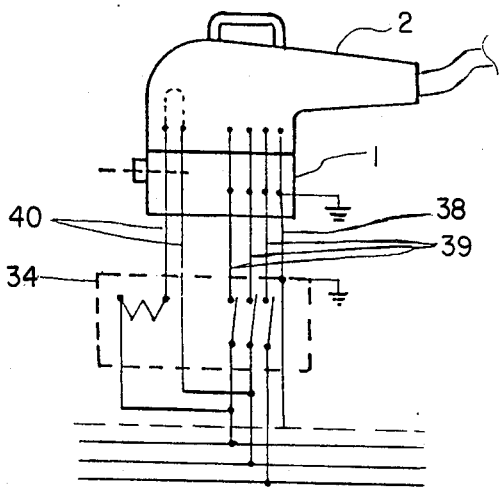
FIG. 9 is a schematic diagram showing a current cutting apparatus controled by pilot circuit.

The term power contacts is used to refer to phase contacts, neutral, and possibly a ground-plate. The term pilot contacts designates the contacts adapted to form a pilot circuit to control, as has already been stated, a current cutting apparatus such as for example 34 (FIG. 9) positioned up circuit of the socket, the wire 38 being connected to ground, wires 39 connected to phase contacts and wires 40 connected to pilot contacts.

Furthermore, it is clear that the pilot contacts can likewise serve as auxiliary contacts to control other apparatus or, for example, to light control lamps.

In the example shown, the socket and the plug are provided with five power contacts (three phases, one neutral and one ground contact) and four pilot contacts (not shown in their entirety in the drawings).

As with many high intensity plugs, the socket is provided with safety disc 10 (shown in FIGS. 2, 5, 6 and 7*a*–7*b*). Safety disc 10 is provided with openings 11*a*–11*e* and 12*a*–12*d* (shown in FIG. 2) for the passage of the power contacts and, respectively, the pilot contacts of the plug respectively.

However, while at rest, openings 11*a*–11*e* and 12*a*–12*d* are not directly aligned with the contacts of the socket so as to avoid touching the latter by accident.

Power contacts 8 of the socket are formed by contact heads 8*a* biased towards the exterior by springs 13 which are supported on an insulating portion of the socket. Contact heads 8*a* are electrically connected in a fixed manner to the socket by flexible blades 14 made of copper (shown in FIGS. 5 and 6).

Pilot contacts 9*a*, 9*b* of the socket are formed in a known manner, as shown in FIGS. 5 and 6, by contact heads 36*a*, 36*b* biased towards the exterior by springs 15*a*, 15*b*. Contact heads 36*a*, 36*b* are electrically connected in a fixed fashion to the socket by conductive braided cables 16*a*, 16*b*. These braided cables can be full braided cables which are arranged in an undulatory configuration. They may also be hollow braided cables which may be compressed. Additionally, other flexible conductors may be used.

According to the invention, contact heads 36*a*, 36*b* of pilot contacts 9*a*, 9*b* of the socket are mounted in insulating block 17. Insulating block 17 is formed in two portions (in order assemble of the contacts). Contact heads 36*a*, 36*b* are movable within the block, and are biased towards the upper portion of the block by springs 15*a*, 15*b*. Springs 15*a*, 15*b* are wedged between the contact heads and a portion of the block.

Block 17 is axially movably mounted in the socket and includes groove into which is introduced driving spur or projection 18. Projection 18 is integrally connected to manipulation apparatus 19 (shown in FIGS. 5 and 6). Manipulation apparatus 19 is rotatably mounted in a sealed fashion in the socket by means of toroidal joint 20.

Manipulation apparatus 29 extends through the socket and has an exterior portion in the form of cam 21 (shown in FIGS. 1, 5, 6, and 7*a*–7*d*).

This exterior portion or cam 21 has the shape of a disc from which a segment has been removed (shown in FIGS. 1, and 7*a*–7*d*).

As is seen more particularly in FIG. 1, plug 2 comprises hooking abutments in the form of pins 22*a* and 22*b* The socket includes edge 23 and projections 24*a*, 24*b* as well as at least one abutment 25, which will be discussed below.

The edge of the socket is provided with reserves or openings 26*a*–26*c* for the passage of pins 22*a*, 22*b* of the plug (plus a pin which is not visible in FIG. 1).

Projection 24*a*, 24*b* (plus one which is not visible in FIG. 1) of the socket includes inclined surfaces 35*a*, 35*b* and right angle portion 27 (shown in FIG. 1).

The plug is furthermore provided with an abutment in the shape of an opening or abutment 28 (shown in FIGS. 1, 5, 6) of the shape and of dimensions which corresponds to the shape of the cam 21, having flat portion 28*a* and rounded portion 28*b*.

The operation of the plug according to the invention described with reference to the figures previously described as well as FIGS. 3 and 4, the schematic diagrams 7*a*–7*d* showing, for the sake of simplicity, only a single pilot contact 7*a* of the plug and only one head of a pilot contact 9*a* of the socket, is as follows.

Figure 7A:
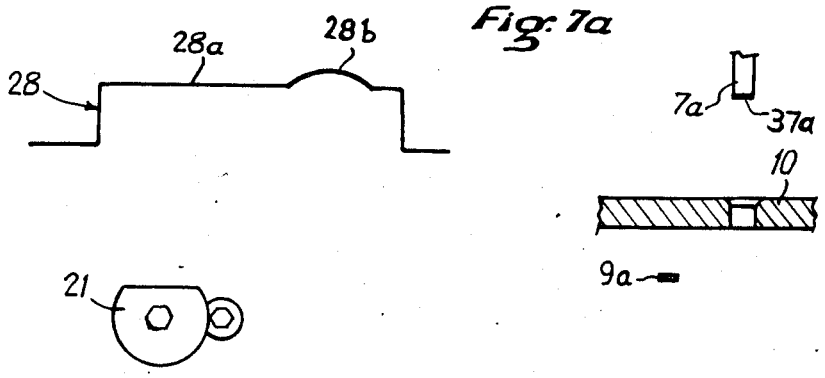

Plug 2 is brought by its handle above socket 1, as shown in FIGS. 1 and 7*a* and cam 21 is in the position shown in FIG. 1.

Contacts 7*a*, 7*b* and 6 of the plug are introduced into openings 11*a*–11*e* and 12*a*–12*c* of safety disc 10 of the socket.

Pins 22*a*, 22*b* of the plug pass, during the course of the introduction of contacts 7*a*, 7*b* and 6 into the respective openings, into the corresponding openings 26*a*, 26*b* of the socket.

It is clear that the angular arrangement of the pins and of the openings appropriately position the plug with respect to the socket.

Figure 3:
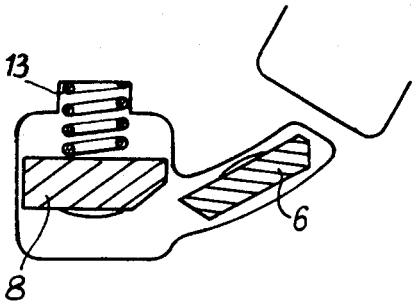
FIGS. 3 and 4 are partial cross-sectional views from an upright position of a pair of power contacts in the two different positions.
Figure 7B:
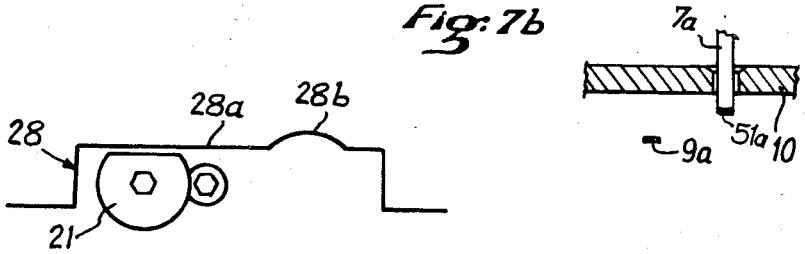

Once introduced, the plug is in the position shown in FIGS. 3 and 7*b*, i.e. that power contacts 6 and 8 and pilot contacts 7*a*, 7*b* and 9*a*, 9*b* are not connected. Contact heads 6*a* and 8*a* of power contacts 6 and 8 are, however, substantially in a single plane but angularly offset from one another.

As is seen more particularly in FIG. 7*b*, this introduction can occur only if cam 21 is in the position shown particularly in FIGS. 1 and 7*b*.

Figure 7C:
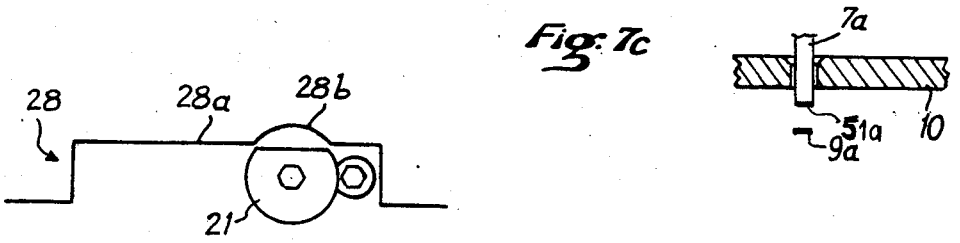
Figure 7D:
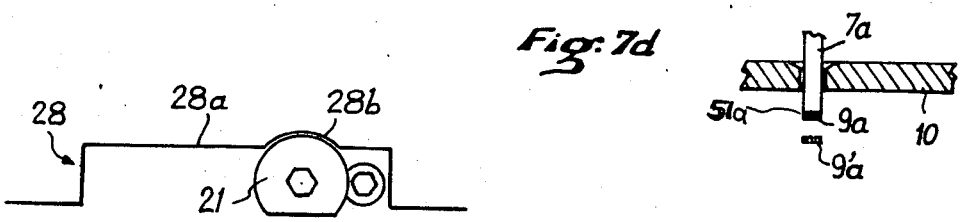

In effect, if cam 21 was in the position shown in FIG. 7*d*, its upper circular portion would strike the flat portion 28*a* of opening 28 of the plug, preventing the plug from being further introduced into the socket.

The position of cam 21 for the introduction is shown in FIG. 5. FIG. 5 also shows that when cam 21 is in this position, mobile block 17 is in its lowest position.

After introduction of the plug, the plug is rotated in the socket.

The rotation of the plug can occur only in a single direction by virtue of abutment 25 which cooperates with pin 22*b*. The angular value of the rotation is limited by right angle portions 27 of projections 24*a*, 24*b* of the socket. Right angle portions 27 serve as abutments which limit the course of pins 22*a*, 22*b*, pins 22*a*, 22*b* hooking under the projections. Inclined surfaces 35*a*, 35*b* of projections 24*a*, 24*b* are oriented downwardly with respect to the direction of rotation of the plug such that the plug will further tighten on the socket. As the plug tightens on the socket, sealing joint 29 (shown in FIGS. 5 and 6 between the socket and the plug) is crushed between the plug and the socket.

During the course of the rotation, the contacts of the plug move safety disc 10.

Figure 4:
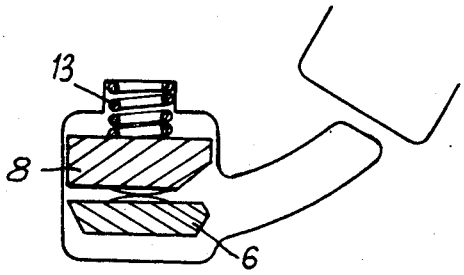

Power contacts 6 of the plug make electrical contact with the power contacts 8 of the socket by rotation, as seen in FIG. 4. Springs 13 assure a pressurized contact.

Pilot contacts 7*a*, 7*b* of the plug face pilot contacts 9*a*, 9*b* of the socket as is seen in FIGS. 5 and 7*c*, but without touching each other (block 17 being in the lower position previously described).

In the position shown in FIGS. 5 and 7*c*, it is clear that the connection of the power contacts is achieved but the pilot contacts are not connected.

Furthermore, it is clear that it is not possible during this manipulation (passage from FIGS. 7*b* to 7*c*) to activate cam 21 because of flattened portion 28*a* of opening 28.

The latter operation consists of connecting the pilot contacts and to do this, cam 21 is turned 180° by means of a key introduced into hexagonal impression 30 provided at the center of cam 21. Opening 28 is provided with notch 31 (shown in FIG. 1) for the passage of the key.

Figure 8:
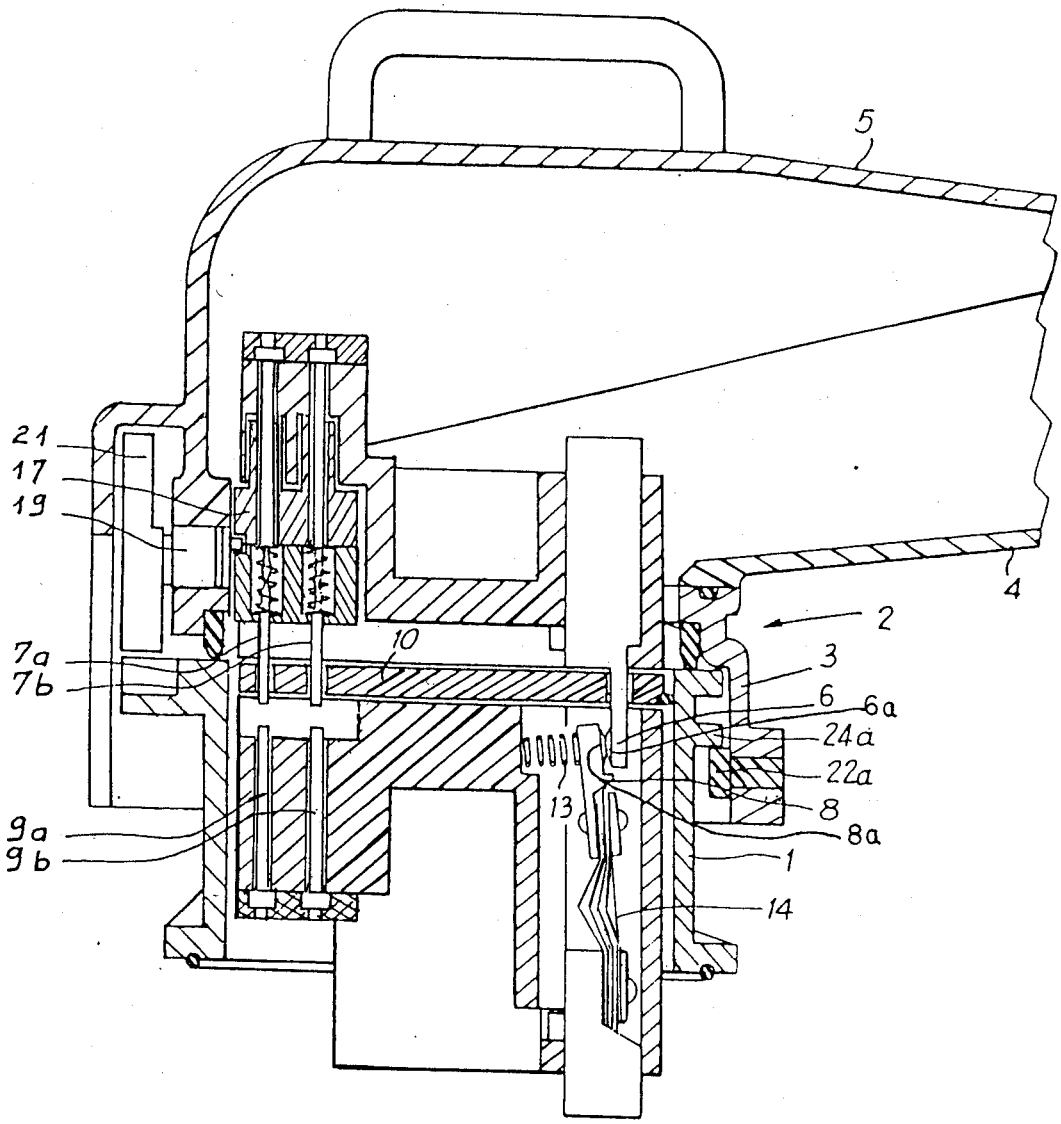
FIG. 8 is an axial cross-sectional view of a second embodiment of the invention wherein the movable pilot contacts are located in the plug.

After rotation of cam 21 as has just been described, cam 21 assumes the position shown in FIGS. 6 and 7*d*, i.e., a circular portion of the cam is positioned in rounded portion 28*b* of opening 28. Thus opening 28 functions to prevent activation of cam 21 because cam 21 cannot be rotated unless it is directly under opening 28. As shown in FIGS. 1–7, the opening 28 can be placed on the plug. Aditionally, the opening 28, along with cam 21 can be placed on the base, as shown in FIG. 8. To the extent that the combination of cam 21 and opening 28 acting together in concert prevents activation of cam 21, means are provided for preventing manipulation of cam 21 both on the socket and on the plug.

In the course of rotation of cam 21, projection 18 of apparatus 19 (FIGS. 5 and 6) moves along a half circle, thus translationally axially moving insulating block 17. In this way contact heads 36*a*, 36*b* of pilot contacts 9*a*, 9*b* of the socket touch contact heads 37*a*, 37*b* of pilot contacts 7*a*, 7*b* of the plug, as shown in FIGS. 6 and 7*d*. In FIG. 7*d*, the anterior position of contact head 9*a* is indicated in draft lines at 9'*a*.

Pilot contacts 9*a*, 9*b* are also in electrical pressurized contact with pilot contacts 7*a*, 7*b* by virtue of springs 15*a*, 15*b*.

During the translational movement of block 17, the contact heads of contacts 9*a*, 9*b* follow the movement of block 17 in response to conductive braided cables 16*a*, 16*b*. Braided cables 16*a*, 16*b* stretch while losing at least a portion of their initial undulation or by expanding to pass from the position of FIG. 5 to that of FIG. 6. As shown in FIG. 6, springs 15*a*, 15*b* are slightly compressed under the force of contacts 7*a*, 7*b*. The reverse movement of block 17 by the opposite rotation of cam 21 quite obviously causes a relaxation of springs 15*a*, 15*b* then an undulation or a compression of braided cables 16*a*, 16*b*.

Cam 21 can furthermore be latched in the position shown in FIGS. 6 and 7*d* by means for example of an attached screw activated by a key introduced into impression 32 provided for this purpose. The key passes through notch 33 of opening 28 (shown in FIG. 1). This latching can likewise be provided for the opened position of the pilot circuits of FIGS. 1, 5 and 7*a*–7*c*.

The connection of the pilot contacts causes the energizing of power contacts 8 of the socket, these being already connected to power contacts 6 of the plug.

It is clear that in this final connection position (shown in FIGS. 6 and 7*d*), it is impossible to turn the plug in the reverse direction because it is retained not only in rotation by cam 21 and the rounded portion 28*b* of opening 28, but also in translation by pins 22*a*, 22*b* and projections 24*a*, 24*b*.

To separate the plug from the socket, it is thus necessary first to unlatch cam 21 and to again manipulate it by 180° to bring it from the position of FIGS. 6 and 7*d* to the position of FIGS. 5 and 7*c*. In this way, the pilot contacts are separated by axial reversed translation of block 17, thus removing the voltage from power contacts 8. The complete separation of the plug from the socket thus occurs by reverse manipulations from those of insertion (reverse rotation, translational separation). After the reverse movements, the power connection is found in the position of FIGS. 1 and 7*a*.

The embodiment described can undergo numerous modifications, particularly as it concerns the number and configurations of the power and pilot contacts, as well as the number and configurations of the abutments and projections.

The above described drawings show apparatus 19 and block 17 located within the socket. A second embodiment of the invention includes apparatus 19 and block 17 located in the plug as shown in FIG. 8. In this second embodiment, manipulation apparatus 19, block 17 and the movable pilot contacts are located within the plug and the fixed contacts are located within the socket.

Although the invention has been described with reference to particular means, materials and embodiments, it is to be understood that the invention is not limited to the particulars disclosed and extends all equivalents within the scope of the claims.

What is claimed:

1. An electric power connection comprising:

(a) a socket comprising first power contacts:

(b) a plug comprising second power contacts adapted to be connected to said first power contacts;

(c) a pilot circuit comprising first pilot contacts provided in said socket and second pilot contacts provided in said plug, said pilot circuit controlling the de-energization and energization of said first power contacts when said circuit is opened and closed, respectively; and (d) manipulation means for preventing certain movements of said plug and said socket when said pilot circuit is in a closed position and for allowing said certain movements when said pilot circuit is in an open position.

2. The electric power connection according to claim 1 wherein said manipulation means is provided on said socket and acts on said first pilot contacts.

3. The electric power connection according to claim 1 wherein said manipulation means is provided on said plug and acts on said second pilot contacts.

4. The electric power connection according to claim 1 wherein said manipulation means prevents said first power contacts from engaging and disengaging from said second power contacts when said pilot circuit is in its closed position.

5. The electric power connection according to claim 1 wherein said pilot circuit is opened and closed by disengaging and engaging, respectively, said first pilot contacts and said second pilot contacts.

6. The electric power connection according to claim 1 wherein said first power contacts and said second power contacts are engaged and disengaged from one another by plugging and unplugging, respectively, said plug and said socket.

7. The electric power connection according to claim 1 wherein said manipulation means further comprises blockage means for said open position and said closed position of said pilot circuit.

8. The electric power connection according to claim 1 further comprising means for preventing activation of said manipulation means while said plug is not inserted into said socket sufficiently to cause said first power contacts to engage said second power contacts, wherein when said manipulation means is activated, said pilot circuit is moved towards a closed position.

9. The electric power connection according to claim 8 wherein said means for preventing activation of said manipulation means is provided on said plug.

10. The electric power connection according to claim 8 wherein said means for preventing activation of said manipulation is provided on said socket.

11. The electric power connection according to claim 8 wherein said means for preventing activation of said manipulation means is provided on said socket and said plug.

12. The electric power connection according to claim 8 wherein said first and second pilot contacts each comprise a contact head.

13. The electric power connection according to claim 12 wherein said contact heads of said first pilot contacts are movable and said contact heads of said second pilot contacts are fixed, said manipulation means acting on said movable contact heads to move them towards and away from said fixed contact heads for connecting and disconnecting, respectively, said first pilot contacts and said second pilot contacts.

14. The electric power connection according to claim 13 wherein (a) said first and second pilot contacts are end contacts:

(b) said movable contact heads are adapted to be moved by springs and flexible conductors;

(c) said springs and flexible conductors are positioned within a block; and (d) said block is axially movably mounted and adapted to be moved by said manipulation means.

15. The electric power connection according to claim 14 wherein said manipulation means comprises rotating means comprising a driving spur which cooperates with an opening in said block for translationally moving said block when said driving spur moves along an arcuate path.

16. The electric power connection according to claim 12 wherein said contact heads of said second pilot contacts are movable and said contact heads of said first pilot contacts are fixed, said manipulation means acting on said movable contact heads to move them towards and away from said fixed contact heads for connecting and disconnecting, respectively, said first pilot contacts and said second pilot contacts.

17. The electric power connection according to claim 16 wherein (a) said first and second pilot contacts are end contacts:

(b) said movable contact heads are adapted to be moved by springs and flexible conductors;

(c) said springs and flexible conductors are positioned within a block; and (d) said block is axially movably mounted and adapted to be moved by said manipulation means.

18. The electric power connection according to claim 17 wherein said manipulation means comprises a rotating means comprising a driving spur which cooperates with an opening in said block for translationally moving said block when said driving spur moves along an arcuate path.

19. The electric power connection according to claim 1 wherein said plug is introduced into said socket and connection of said power contacts is achieved by turning said plug in said socket.

20. The electric power connection according to claim 19 wherein said manipulation means comprises:

(a) a rotating activation portion comprising a cam; and (b) at least one first abutment having a configuration which cooperates with said cam such that when said plug is introduced into said socket and said pilot circuit is in closed position, said cam abuts against a first portion of said at least one first abutment and prevents further introduction of said plug into said socket.

21. The electric power connection according to claim 20 wherein when said plug is introduced into said socket and said pilot circuit is in an open position, said cam and said abutment do not prevent further introduction of said plug into said socket.

22. The electric power connection according to claim 21 wherein said pilot circuit is closed by rotation of said cam after rotation of said plug within said socket and connection of said power contacts.

23. The electric power connection according to claim 22 wherein after the rotation of said cam, inverse rotation of said plug is blocked by cooperation of said cam and a second portion of said at least one first abutment and by hooking means provided on said plug and said socket.

24. The electric power connection according to claim 23 wherein said cam is provided on an exterior portion of said socket and said at least one first abutment is provided on said plug.

25. The electric power connection according to claim 23 wherein said cam is provided on an exterior portion of said plug and said at least one first abutment is provided on said socket.

26. The electric power connection according to claim 23 wherein said hooking means comprises:

(a) pins provided in said plug; and (b) projections provided in said socket, said pins being adapted to hook under said projections in response to rotation of said plug in said socket.

27. The electric power connection according to claim 26 wherein said projections comprise an inclined surface having an orientation which allows said plug to be brought closer to said socket during rotation of said plug in said socket and allows a sealing joint positioned between said plug and said socket to be crushed.

28. The electric power connection according to claim 26 wherein said socket comprises:

(a) at least one second abutment adapted to prevent rotation of said plug in an incorrect direction after said plug is introduced into said socket; and (b) at least one third abutment adapted to limit rotation of said plug in said socket wherein said at least one second and third abutments are adapted to cooperate with said pins.

29. The electric power connection according to claim 26 wherein said socket further comprises an edge, said edge comprising openings adapted to receive said pins, wherein said openings have an angular orientation such that proper introduction of said plug into said socket is imposed.

30. An electric power connection comprising:

(a) a socket comprising at least one socket power contact;

(b) a plug comprising at least one plug power contact, said at least one plug power contact corresponding in number and placement to said at least one socket power contact;

(c) a pilot circuit comprising at least one socket pilot contact aqnd at least one plug pilot contact, said at least one plug pilot contact corresponding in number and placement to said at least one socket pilot contact, said pilot circuit adapted to control the power supplied to said at least one plug power contact and said at least one socket power contact; and (d) manipulation means for controlling said pilot circuit and preventing insertion of said plug into said socket when said at least one socket pilot contact and said at least one plug pilot contact are in a closed position.

31. The electric power connection according to claim 30 wherein (a) each of said at least one socket pilot contact comprises a contact head located on a free end of said at least one socket pilot contact;

(b) each of said at least one plug pilot contact comprises a contact head located on a free end of said at least one plug pilot contact;

(c) said contact heads of said at least one socket contact are movable;

(d) said contact heads of said at least one plug contact are fixed; and wherein said manipulation means acts on said contact heads of said at least one socket contact to move them both towards and away from said contact heads of said at least one plug contact, whereby said at least one socket pilot contact is operatively connected to said at least one plug pilot contact when said at least one socket pilot contact comes into contact with said at least one plug pilot contact.

32. The electric power connection according to claim 31 further comprising an axially movable block mounted in said socket, said block comprising a plurality of springs and flexible conductors for moving said contact heads of said at least one socket contact, and wherein said manipulation means is operable to move said block from a first position to a second position and from said second position to said first position.

33. The electric power connection according to claim 32 wherein said manipulation means comprises a driving spur rotatably mounted in said manipulation means for cooperating with a groove in said block for translationally moving said block from a first position to a second position and from said second position to said first position, when said driving spur moves along an arcuate path.

34. The electric power connection according to claim 33 wherein said manipulation means further comprises;

(a) a cam connected to an exterior portion of said socket connected to said driving spur;

(b) at least one first abutment adapted to cooperate with said cam such that rotation of said cam is prevented until said plug is fully inserted into said socket and complete insertion of said plug into said socket is prevented when said block is in said second position.

35. The electric power connection according to claim 34 wherein said pilot circuit is closed by rotation of said cam after said plug is fully inserted into said socket and said plug is rotated within said socket, said rotation of said cam causing said driving spur to move along said arcuate path and thereby move said block to said second position causing said contact heads of said at least one socket contact to come into contact with said contact heads of said at least one plug contact.

36. The electric power connection according to claim 35 wherein after rotation of said cam, inverse rotation of said plug within said socket is prevented by cooperation of said cam and a portion of said at least one first abutment and by hooking means provided on said plug and said socket.

37. The electric power connection according to claim 36 wherein said hooking means comprises:

(a) a plurality of pins located on said plug; and (b) a plurality of corresponding projections located on said socket, wherein said plurality of pins are adapted to hook under said plurality of projections in response to rotation of said plug in said socket.

38. The electric power connection according to claim 37 wherein said plurality of projections each comprise an inclined surface having an orientation such that said plug is brought closer to said socket during rotation of said plug in said socket and a sealing joint positioned between said plug and said socket is crushed.

39. The electric power connection according to claim 38 wherein said socket comprises:

(a) at least one second abutment adapted to prevent reotation of said plug in an incorrect direction after said plug is introduced into said socket; and (b) at least one third abutment adapted to limit rotation of said plug in said socket wherein said at least one second and third abutments are adapted to cooperate with said pins.

40. The electric power connection according to claim 39 wherein said socket further comprises an edge, said edge comprising openings adapted to receive said pins, wherein said openings have an angular orientation such that proper introduction of said plug into said socket is assured.

41. The electric power connection according to claim 40 wherein said manipulation means further comprises blockage means for locking said pilot circuit in said open position and said closed position.

42. A switch including a plug and a socket for use with high intensity current comprising:

(a) a power circuit;

(b) a pilot circuit for maintaining current flowing through said power circuit; and (c) means for controlling said pilot circuit and preventing insertion of said plug into said socket when at least one pilot contact is in a closed position.

43. The switch according to claim 42 wherein current flows through said power circuit when at least one socket power contact comes into contact with at least one plug power contact and said pilot circuit is closed.

44. The switch according to claim 43 wherein (a) said pilot circuit comprises:

(i) at least one socket pilot contact position in said socket;

(ii) at least one plug pilot contact positioned in said plug, wherein current flows through said power circuit only when said at least one socket pilot contact comes into contact with said at least on plug pilot contact; and (b) said means for controlling said pilot circuit comprises a block in which said at least one socket pilot contact is located, said block being axially movable between a first and second position, wherein when said block is in said second position, said at least one socket pilot contact is in contact with said at least one plug pilot contact.

45. The switch according to claim 44 wherein said means for controlling said pilot circuit further comprises:

(a) a driving spur rotatably mounted in said means for controlling said pilot circuit for cooperating with a groove in said block for axially moving said block between said first and second positions as said driving spur moves along an arcuate path;

(b) a cam connected to said driving spur; and (c) at least one abutment adapted to cooperate with said cam to prevent rotation of said cam unless said plug is fully inserted in said socket and to prevent complete insertion of said plug into said socket unless said block is in said first position.

46. The switch according to claim 45 wherein said pilot circuit is closed by rotation of said cam after said plug is fully inserted into said socket and said plug is rotated within said socket, wherein said driving spur moves along with arcuate path in response to rotation of said cam, said block axially moves from said first position to said second position in response to said driving spur, and said at least one socket pilot contact engages said at least one plug pilot contact in response to said block movement.

* * * * *